US007415741B1

(12) United States Patent
Wasley et al.

(10) Patent No.: US 7,415,741 B1
(45) Date of Patent: Aug. 26, 2008

(54) SURGICAL PATIENT POSITIONER EXTENSION UNIT

(75) Inventors: Alan Wasley, Southington, CT (US); James Bailey, Plainville, CT (US)

(73) Assignee: IMP Inc., Plainville, CT (US)

( * ) Notice: Subject to any disclaimer, the term of this patent is extended or adjusted under 35 U.S.C. 154(b) by 318 days.

(21) Appl. No.: 11/329,726

(22) Filed: Jan. 12, 2006

(51) Int. Cl.
*A61G 13/12* (2006.01)

(52) U.S. Cl. ..... 5/621; 5/632; 5/723

(58) Field of Classification Search ..... 5/621, 5/722, 723, 657, 640, 632; 52/589.1, 592.1; 404/35, 41
See application file for complete search history.

(56) References Cited

U.S. PATENT DOCUMENTS 1,823,039 A * 9/1931 Gruner ..... 52/592.4
1,885,974 A * 11/1932 Winn ..... 5/723
2,415,150 A * 2/1947 Stein ..... 5/710
2,548,547 A * 4/1951 Melrose ..... 5/723
2,740,167 A * 4/1956 Rowley et al. ..... 52/591.1
3,274,624 A * 9/1966 Noerdinger ..... 5/710
3,301,147 A * 1/1967 Clayton et al. ..... 404/35
3,377,931 A * 4/1968 Hilton ..... 404/35
3,379,104 A * 4/1968 Scholl ..... 404/35
3,379,472 A * 4/1968 Hilfiker ..... 297/118
3,385,183 A * 5/1968 Kortz ..... 404/35
3,564,801 A * 2/1971 Huerta ..... 52/580
3,706,473 A * 12/1972 Mullen ..... 297/452.16
3,787,909 A * 1/1974 Johnson ..... 52/578
3,829,079 A * 8/1974 Fox ..... 5/621
3,859,000 A * 1/1975 Webster ..... 404/1
3,877,093 A * 4/1975 Gershbein ..... 5/723
4,426,820 A * 1/1984 Terbrack et al. ..... 52/590.1
4,522,381 A * 6/1985 Ludwick ..... 5/621
4,603,444 A * 8/1986 Suits ..... 5/657
4,962,553 A * 10/1990 Marquis ..... 5/710
5,098,218 A * 3/1992 Reese et al. ..... 404/35
5,289,603 A * 3/1994 Kumagai ..... 5/621
5,360,392 A * 11/1994 McCoy ..... 602/6
5,484,393 A * 1/1996 McCoy ..... 602/6
5,513,402 A * 5/1996 Schwartz ..... 5/691
5,630,304 A * 5/1997 Austin ..... 52/384
5,797,237 A * 8/1998 Finkell, Jr. ..... 52/589.1
5,819,349 A * 10/1998 Schwartz ..... 5/740
6,003,176 A * 12/1999 Wasley et al. ..... 5/624
6,363,678 B1 * 4/2002 Shuler ..... 52/656.9
6,371,119 B1 * 4/2002 Zadini et al. ..... 128/845
6,536,178 B1 * 3/2003 Pålsson et al. ..... 52/589.1
6,591,568 B1 * 7/2003 Pålsson ..... 52/592.2
6,647,690 B1 * 11/2003 Martensson ..... 52/601
6,652,183 B2 * 11/2003 Stasiewich et al. ..... 404/35
6,685,391 B1 * 2/2004 Gideon ..... 405/16
6,733,206 B2 * 5/2004 Stasiewich et al. ..... 404/41
6,769,835 B2 * 8/2004 Stridsman ..... 404/41
6,854,235 B2 * 2/2005 Martensson ..... 52/601
6,934,987 B2 * 8/2005 Newkirk et al. ..... 5/613
6,966,161 B2 * 11/2005 Palsson et al. ..... 52/589.1
7,025,530 B2 * 4/2006 Beamish et al. ..... 404/41

(Continued)

FOREIGN PATENT DOCUMENTS

GB 2079591 A * 1/1982

*Primary Examiner*—Robert G Santos

(57) ABSTRACT

A modular surgical patient positioner unit is formed by attaching a plastic linear extension board to a peg board by means of a perforated metal bridging plate. An elongated metal support bar is fastened along one side of the linear extension board for added strength and functionality.

7 Claims, 3 Drawing Sheets

U.S. PATENT DOCUMENTS

| | | | | |
|---|---|---|---|---|
| 7,100,225 | B1 * | 9/2006 | Bailey et al. | 5/621 |
| 7,121,058 | B2 * | 10/2006 | Palsson et al. | 52/592.2 |
| 7,160,055 | B2 * | 1/2007 | Beamish et al. | 404/36 |
| D553,751 | S * | 10/2007 | Penenberg et al. | D24/184 |
| 7,332,053 | B2 * | 2/2008 | Palsson et al. | 156/305 |
| 2002/0176744 | A1 * | 11/2002 | Stasiewich et al. | 404/41 |
| 2002/0176745 | A1 * | 11/2002 | Stasiewich et al. | 404/41 |
| 2002/0189183 | A1 * | 12/2002 | Ricciardelli | 52/390 |
| 2003/0037504 | A1 * | 2/2003 | Schwitte et al. | 52/586.1 |
| 2003/0167569 | A1 * | 9/2003 | Newkirk et al. | 5/613 |
| 2004/0035079 | A1 * | 2/2004 | Evjen | 52/592.1 |
| 2004/0255870 | A1 * | 12/2004 | McGregor | 119/528 |
| 2005/0081796 | A1 * | 4/2005 | McGregor | 119/509 |
| 2006/0165486 | A1 * | 7/2006 | Ungurean | 404/40 |
| 2006/0185287 | A1 * | 8/2006 | Glazer et al. | 52/403.1 |
| 2007/0089239 | A1 * | 4/2007 | Whiteside | 5/624 |

* cited by examiner

SURGICAL PATIENT POSITIONER EXTENSION UNIT

BACKGROUND OF THE INVENTION

Single and multi-piece patient positioner units in the form of an elongated plastic plate or board, hereafter "peg board", having a plurality of peg holes for receiving patient positioning pegs are currently used to support a patient during surgical procedures.

The peg board is generally co-extensive with the hospital O.R. table and is removably secured to the side rails thereof by means of clamps.

One such modular patient positioner unit is described within U.S. patent application Ser. No. 11/097,626 filed Apr. 4, 2005 entitled "Modular Surgical Patient Positioner", which application is incorporated herein for purposes of reference.

When hip surgery is performed on a patient, an extended hip positioner plate, such as a type CJ-001 supplied by Cj Medical Inc. is generally employed to secure the patient in a stable fashion and to eliminate movement when the patient is supine or in the lateral position.

It would be both cost and space savings effective to provide a single patient positioner unit having facility for multiple surgical function including hip and knee surgery with only minor modification to the unit to capture the patient in the supine or in the lateral position.

One purpose of the instant invention is to provide a radiolucent board having a plurality of peg holes for receiving patient positioning pegs, and which includes means for temporary attachment of an elongated plastic plate with side rails to attach accessories.

SUMMARY OF THE INVENTION

A modular surgical patient positioner unit is disclosed having a plastic rectangular peg board arranged for attachment to a hospital surgical O.R. table. A plastic linear extension board is attached to the peg board by means of a perforated metal bridging plate. An elongated metal support bar is fastened along one side of the linear extension board for added strength, functionality and accessory attachment.

DESCRIPTION OF THE PREFERRED EMBODIMENT

Figure 1:
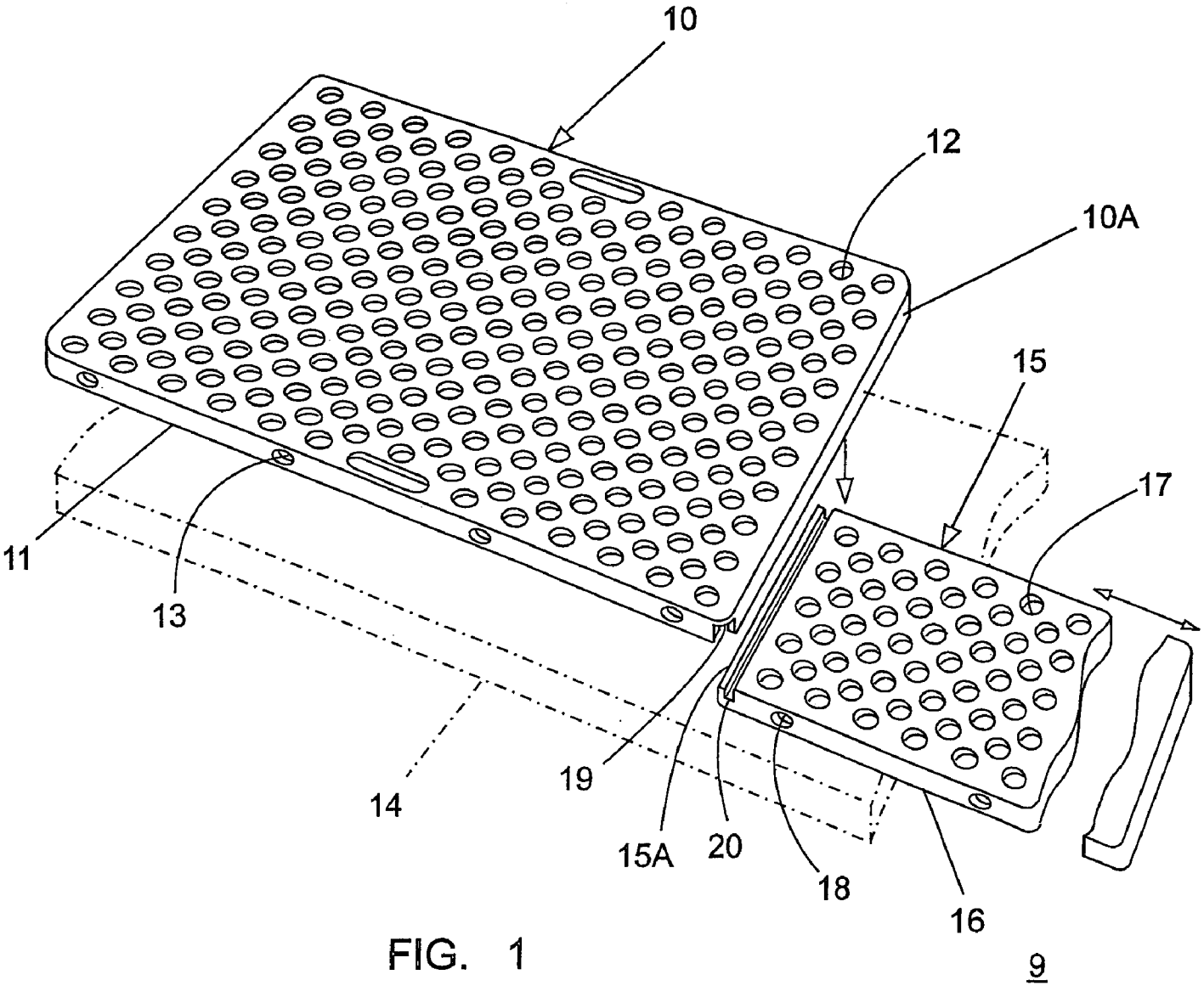
FIG. 1 is a top perspective view of the peg board in isometric projection to the extender board accessory and the patient operating table.

FIG. 1 depicts the modular surgical positioner unit 9 consisting of a plastic peg board 10 in combination with a plastic extender board 15 of approximately equal length and half the width of the peg board. The peg board 10 is in the form of a rectangular plate 11 having a plurality of top openings 12 for receiving patient support pegs (not shown) as described in the aforementioned US patent application. A plurality of side openings 13 are arranged along the side 11 for purposes to be described below in greater detail. The lower portion 10A of the peg board 10 is formed to provide a downwardly extended slot 19 for receiving the front 15A of the plastic extender board 15 having an upwardly extended slot 20 formed therein, when the peg board 10 is moved in the downward indicated direction relative to the patient support table indicated at 14, in phantom. The extender board 15, having a length of approximately half the width of the extender board and a width equal to that thereof, includes a plurality of top openings 17 which are positioned underneath corresponding top openings 12 on the peg board 10. A plurality of side openings 18 are arranged on the side 16 of the extender board 15 for cooperating with the side openings 13 on the side 11 of the peg board 10 via the openings 23 on the side support bar 22 as best seen by now referring to FIG. 2.

Figure 2:
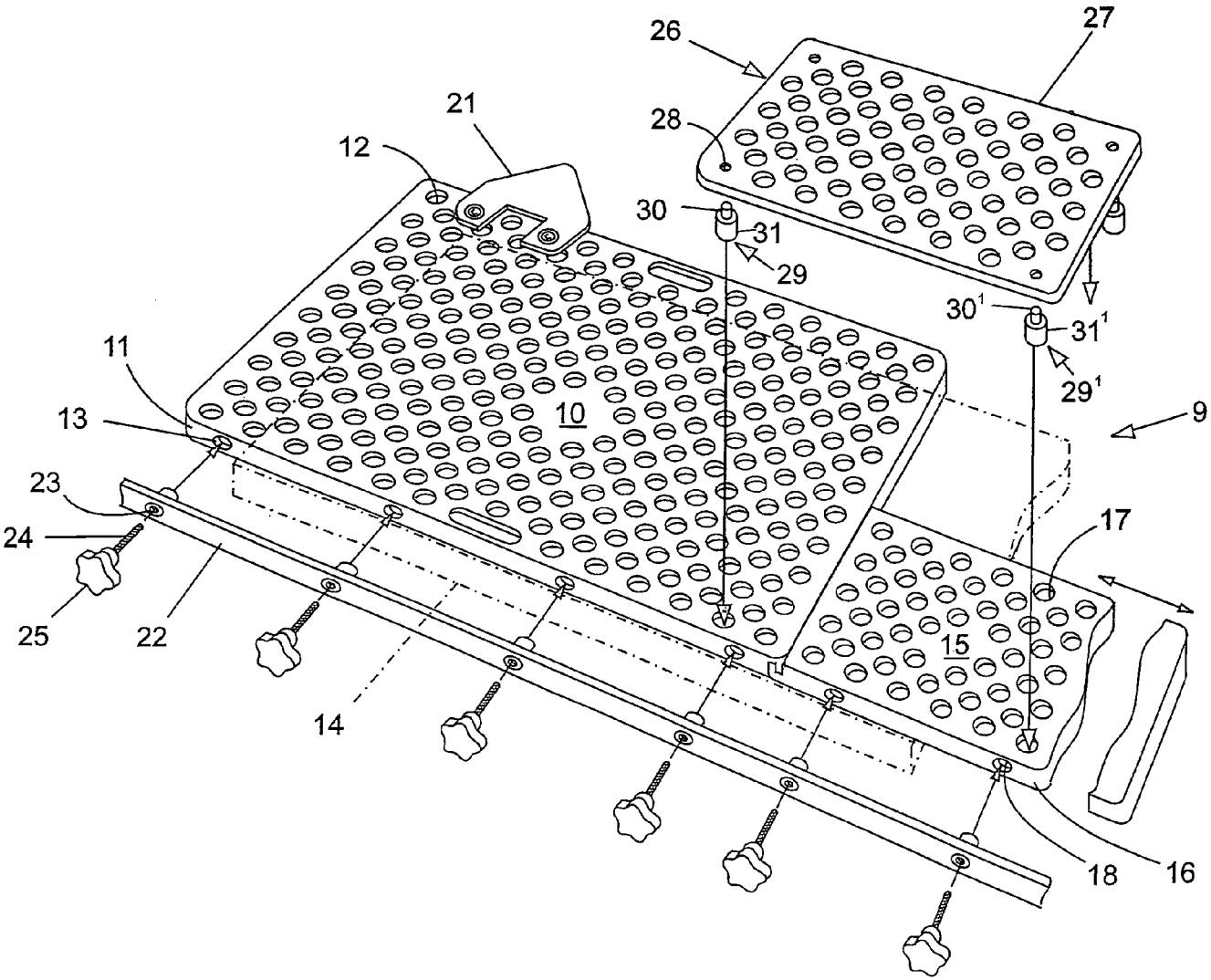
FIG. 2 is a top perspective view of the bridging plate and side support bar in isometric projection to the extender board and the peg board.

FIG. 2 depicts the modular surgical positioner unit 9 in the combination of the extender board 15 attached to the peg board 10 via the extended slots 19, 20 shown earlier in FIG. 1 with the peg board attached to the side rail (not shown) on the patient support table 14, by means of the clamp 21. The metal side support bar 22 is now attached to the peg board 10 and extender board 15 by passing the threaded rods 24, connecting with the knobs 25, first thru the openings 23 on the support bar 22 and then thru the corresponding openings 18 on the side 16 of extender board side 18 and corresponding openings 13 on the side 11 of the peg board 10, which are internally threaded to receive the threaded rods 24. The side support bar 22 further serves to support additional surgical apparatus and accessories such as a knee support device, for example.

The bridging plate 26, in the form of a rectangular metal plate 27, which includes bridging plate openings 28, is positioned over part of the peg board 10 and part of the extender board 15 so that some of the bridging plate openings 28 align with some of the peg board openings 12 while some other bridging plate openings 28 align with some other of the extender board openings 17.

A dual configuration metal locking pin 29 is positioned intermediate the bridging plate 26 and the peg board 10 and one of the locking pin top extensions 30 is inserted within one of the bridging plate openings 28 in press-fit relation and one of the locking pin bottom extensions 31 is inserted within a corresponding one of the peg board openings 12 in press-fit relation.

A similar metal locking pin 29' is positioned intermediate the bridging plate 26 and the extender plate 15 and one of the locking pin top extensions 30' is inserted within one of the bridging plate openings 28 a in press-fit relation and one of the locking pin bottom extensions 31' is inserted within a corresponding one of the extender plate openings 17 in press-fit relation to securely fasten the bridging plate 26 to both the peg board 10 and the extender plate 15. Although only two such locking pins 29, 29' are depicted for purposes of clarity, two further locking pins (not shown) are similarly attached to the opposite side of the bridging plate 26 and are connected with the peg board 10 and the extender plate 15 in a similar manner.

Figure 3:
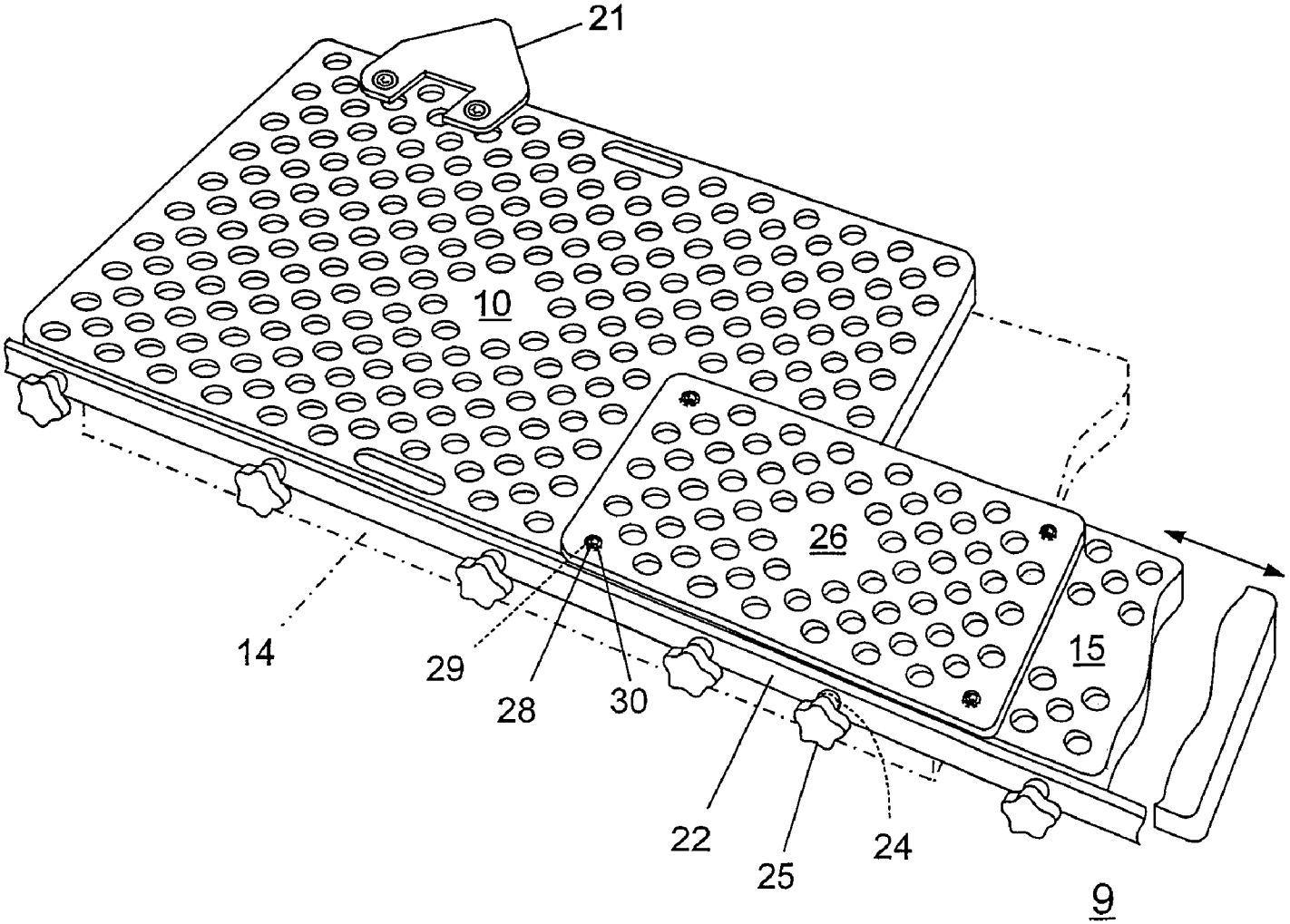
FIG. 3 is a top perspective view of the peg board attached to the extender plate via the top bridging plate and side support bar in accordance with the invention.

The modular surgical positioner unit 9 is shown in FIG. 3 with the peg board 10 fixedly attached to the extender board 15 via the bridging plate 26 and with the peg board attached to the patient support table 14, again depicted in phantom, by means of the clamp 21. The side support bar 22 provides additional support to the surgical positoner unit 9 by connection to both the peg board 10, the extender board 15 by means of the knobs 25 and threaded rods 24 in the manner described earlier.

The side support bar 22 also functions to support additional surgical support devices within the operating room sterile field, such as the IMP Knee Positoner (not shown) supplied by IMP Inc. of Plainville, Conn. The bridging plate 26 which further secures the peg board 10 to the extender board 15 by means of the locking pins 29 whereby the top extensions 30 extend within the openings 28, as described earlier, is accordingly an important feature of the invention.

A modular surgical positioner unit for a variety of hip and knee surgery procedures has been herein disclosed. The extender board and the peg board components can be separately employed for other type surgical procedures at substantial cost savings to the operating facility.

What is claimed is:

1. A modular surgical patient positioner unit for a variety of hip and knee surgery procedures comprising:

a rectangular peg board having a first width and a first length dimension;

a rectangular extender board having a second width and a second length dimension;

a bridging plate having a third width and a third length dimension, said bridging plate being arranged for interconnecting said peg board and said extender board when said peg board and said extender board are arranged in a common plane, said bridging plate is attached to said peg board and said extender board by means of a plurality of locking pins, wherein said peg board and said extender board comprise plastic and said bridging plate comprises metal; and a side support bar arranged for further interconnecting with said peg board and said extender board and being spaced apart from said bridging plate.

2. The modular surgical patient positioner unit of claim 1 wherein said peg board includes peg board top openings extending thru said peg board in a first direction, said extender board includes extender board top openings extending thru said extender board in said first direction and said bridging plate includes bridging plate top openings extending thru said bridging plate in said first direction.

3. The modular surgical patient positioner unit of claim 2 wherein said locking pins comprise a first diameter extension and a second diameter extension whereby said first diameter extension is arranged for insertion within said bridging plate top openings and said second diameter extension is arranged for insertion within said extender board top openings and said peg board top openings for securing said bridging plate to said peg board and said extender board.

4. The modular surgical patient positioner unit of claim 2 wherein said peg board further includes peg board side openings and said extender board further includes extender board side openings extending within said peg board and said extender board in a second direction, perpendicular to said first direction.

5. The modular surgical patient positioner unit of claim 4 wherein said side support bar includes side support bar side openings arranged for alignment with said peg board side openings and said extender board side openings.

6. The modular surgical patient positioner unit of claim 5 further including a plurality of knobs having threaded rods attached thereto, whereby said threaded rods are arranged within said side bar side openings, said extender board side openings and said peg board side openings for fastening said side bar to said extender board and said peg board.

7. A modular surgical patient positioner unit for a variety of hip and knee surgery procedures comprising:

a rectangular peg board having a first width and a first length dimension;

a rectangular extender board having a second width and a second length dimension;

a bridging plate having a third width and a third length dimension, said bridging plate being arranged for interconnecting said pea board and said extender board when said peg board and said extender board are arranged in a common plane, said bridging plate is attached to said pea board and said extender board by means of a plurality of locking pins; and a side support bar arranged for further interconnecting with said peg board and said extender board and being spaced apart from said bridging plate, wherein said peg board includes a lateral slot extending along a bottom of one end of said peg board for receiving a lateral slot extending along a top of one end of said extender board when said extender board is interconnected with said peg board.

* * * * *